United States Patent [19]

Anderson

[11] Patent Number: 4,605,253

[45] Date of Patent: Aug. 12, 1986

[54] CARPET SEAM ROLLER

[76] Inventor: Martin L. Anderson, 4417 Third Street NE., Minneapolis, Minn. 55428

[21] Appl. No.: 783,560

[22] Filed: Oct. 3, 1985

[51] Int. Cl.[4] ..... A47G 27/04

[52] U.S. Cl. ..... 294/8.6; 29/270

[58] Field of Search ..... 29/235, 270; 294/8.6; 254/200, 209

[56] References Cited

U.S. PATENT DOCUMENTS

| | | | |
|---|---|---|---|
| 393,909 | 12/1888 | Kingsland | 294/8.6 |
| 1,544,601 | 7/1925 | Schade | 29/270 |
| 3,617,082 | 11/1971 | Sparks | 294/8.6 |

*Primary Examiner*—James L. Jones, Jr.

*Attorney, Agent, or Firm*—Orrin M. Haugen; Thomas J. Nikolai

[57] ABSTRACT

A seam roller to be used when installing carpeting which, when used, draws the opposed edges of adjacent runs of carpeting together while applying a downward pressure to tightly bond the carpeting to an adhesive layer. The tool comprises a roller mounting plate having at least two pairs of integrally formed opposed legs bent out of the plane of the mounting plate a first of said pair being generally at right angles to the plane of the plate while a second pair is bent at a predetermined acute angle with respect to the plane of the plate. A first roller assembly is journaled for rotation on an axle extending between the first pair of legs while each of the legs in the other pair supports two flat disc-like washers on independent axles in a parallel and spaced-apart relationship to one another. The respective diameters of the spaced-apart washers rotationally supported on the second pair of legs are such that their peripheries lie in a common horizontal plane.

When the above-described tool is drawn along the seam area between two runs of carpeting under which seam area an adhesive has been pre-applied, the skewed disc-like washers urge the two carpet edges together as the first roller forces the seam area downward into the softened adhesive resulting in an almost imperceptible seam between the two carpet runs.

5 Claims, 7 Drawing Figures

CARPET SEAM ROLLER

BACKGROUND OF THE INVENTION

I. Field of the Invention

This invention relates generally to carpet installing tools, and more specifically to a hand-operated seam roller which operates to draw the edges of two carpet runs being laid into a tight abutting relationship along a seam line while simultaneously setting the carpet edges firmly into the adhesive.

II. Discussion of the Prior Art

When installing carpet on a floor which is wider than the length of the carpet roll, it becomes necessary to abut two or more runs of carpeting from that roll in a side-by-side relationship on the floor along a seam line. It is, of course, desirable that once the carpeting is installed, the seam lines be invisible. It is also common practice to adhesively bond the carpet edges to the underlying flooring along and on either side of the seam line so that the seam will not come apart and become frayed and therefore visible. Hot melt adhesives are now commonly used.

To set the seam, carpet installers have in the past employed heavy rollers which are drawn over the seam line and which function to set the carpeting firmly against the adhesive layer. A problem has existed, however, in that as the rolling operation takes place, it is important that the edges of the two carpet runs being joined not separate. This requires the installer to repeatedly set the roller aside, pull the edges of the carpet together, pick up the roller, roll the seam, etc. which is cumbersome and time consuming.

The Gundlack Corporation of Belville, Ill., makes a carpet roller sold under the trademark "Carpet Tractor", but this device does not work to pull the seam edges together. It only can be used to apply a vertical force to set the carpet into the softened adhesive. The Orcon Corporation of Union City, Calif., makes a carpet roller sold under the trademark "Flex-Roller" which, while the rollers are configured to provide a tangential force tending to force the edges together, these forces are constantly applied as the tool is used and it results in frequent overlapping of the carpet edges, which, of course, must be avoided if the seam is to be unnoticeable. Both of the above prior art devices also leave unsightly and noticeable tracks on some carpet fabrics.

SUMMARY OF THE INVENTION

The carpet seam roller of the present invention obviates the foregoing problems attendant with the prior art devices intended for the same purpose. Specifically, using the roller of the present invention, only a single person is needed to roll the seam in that the roller tool to be described herein functions not only to force the carpet edges along the seam line into the adhesive base, but simultaneously draws the two edges being glued down into a close abutting relationship to one another along the seam line. The tool comprises a roller mounting plate having at least two pairs of integrally formed opposed legs bent out of the plane of the mounting plate, a first of said pair being generally at right angles to the plane of the plate while the second pair is bent at a predetermined acute angle with respect to the plane of the plate. A first roller assembly is journaled for rotation on an axle extending between the first pair of legs while each of the legs in the other pair supports two flat, disc-like washers on independent axles in a parallel and spaced-apart relationship to one another. The respective diameters of the two spaced-apart washers rotationally supported on the second pair of legs are such that their peripheries lie on a straight line which is closer to the mounting plate than is the bottom of the first roller assembly.

When the above-described tool is tipped from the horizontal and drawn forward along the seam area between two runs of carpeting under which seam area an adhesive has been pre-applied, the skewed disc-like washers disposed on either side of the seam line urge the two carpet edges together as the first roller forces the seam area downward into the softened adhesive resulting in an almost imperceptible seam between the two carpet runs.

OBJECTS

It is accordingly a principal object of the present invention to provide a new and useful tool for facilitating the laying of floor carpeting.

Another object of the invention is to provide a tool for creating substantially invisible seams between two runs of carpeting.

A further object of the invention is to provide a carpet installing tool for facilitating the joining of cooperating edges of two carpet runs to form an invisible seam and which can be accomplished using one person only.

A still further object of the invention is to provide a carpet seam rolling tool that, when drawn along the joint between two carpet runs, acts to pull the apposed carpet edges laterally against one another while simultaneously pushing the carpet edges downward into an underlying adhesive layer.

Yet still another object of the invention is to provide a tool of the type described which is small in size, light in weight and which can be readily carried in a carpet installer's tool box.

These and other objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
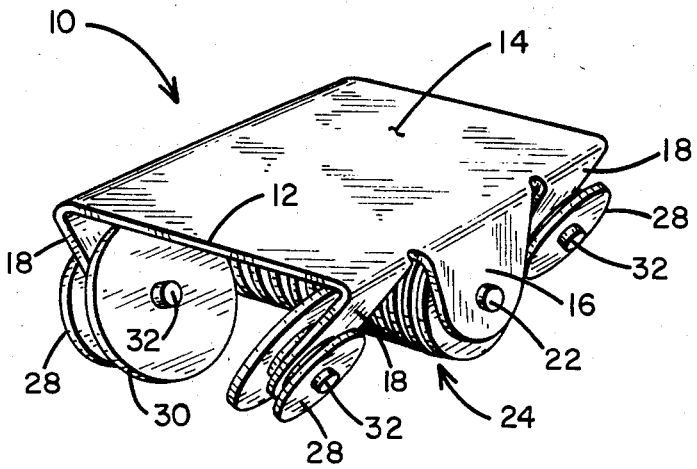
FIG. 1 is a perspective view of the improved tool of the present invention.

Referring first to FIG. 1, there is indicated generally by numeral 10 a preferred embodiment of the carpet roller tool of the present invention. The tool 10 is seen to comprise a roller mounting plate 12 which may be stamped from 12 ga. steel and then bent to have a generally planar top surface 14 and downwardly depending, integrally formed leg members which are arranged in pairs across the width dimension of the tool. More specifically, a first pair of legs 16—16 are bent downwardly approximately midway along the length of the plate 12, those legs being generally at right angles to the planar top surface 14. Disposed on either side of the leg pair 16—16 are leg pairs 18—18 and 20—20. In each instance, the latter leg pairs are bent downwardly and inwardly at an angle greater than 90° so as to form a generally acute angle (typically 45°) with the undersurface of the mounting plate 12. The top planar surface 14 may be four inches long and three inches wide, but limitation to these measurements as well as to others mentioned herein is not intended.

Figure 4:
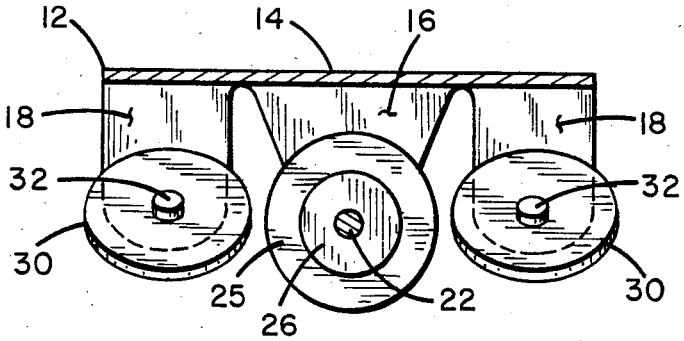
FIG. 4 is a cross-sectional view taken along section line 4—4 in FIG. 3.
Figure 7:
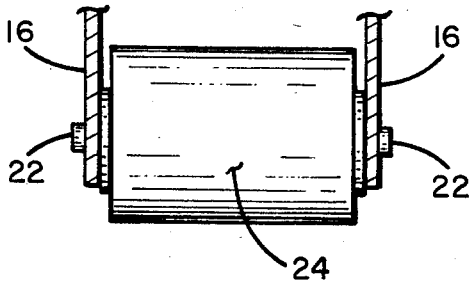
FIG. 7 is a further alternative embodiment of the invention.

An axle member 22 extends between holes formed proximate the bottom edge of the central leg pair 16—16 and mounted for rotation on the axle 22 is a roller 24 comprised of a series of spaced-apart discs or washers 25. The spacing between washers may be maintained by a similar set of washers but of a lesser diameter. These latter washers can be seen in the cross-sectional view of FIG. 4 and are identified by numeral 26. Both washers 25 and 26 may typically be formed from 16 ga. steel with washers 25 being one inch to one and three-quarters inches in diameter and washers 26 being one-half inch in diameter.

It has been found beneficial when working with some types of carpeting that the washers 25 and the spacers 26 not be tightly packed between the legs 16—16 so that the washers 25 will be free to wobble and shift back and forth laterally to a slight degree as the roller 24 is played across the carpet seam. In this fashion, the washers 25 tend to find their way between the tufts of carpet fibers to more firmly press the carpet backing down into the softened carpet adhesive.

Affixed to each of the individual legs in the leg pairs 18—18 and 20—20 are further disc-like washers, but in this case only two such washers 28 and 30 are journaled for rotation on an axle or shaft 32 which pass through holes drilled through the thickness dimension of the individual legs.

Figure 3:
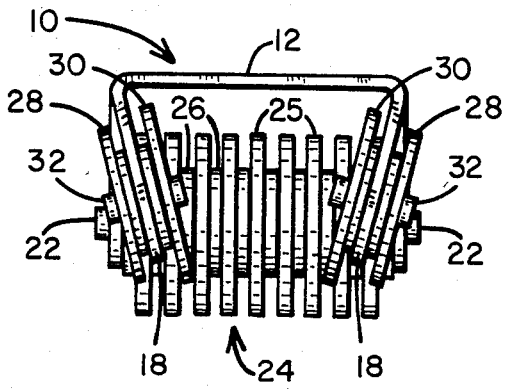
FIG. 3 is a front elevation of the tool of FIG. 1.

Referring to the front view of FIG. 3, the washers 28 and 30 are sized so that the respective points of tangency with the floor surface lie on a straight line. In that the axles 32 passing through the individual legs of the leg pairs 18—18 and 20—20 extend perpendicularly to those legs, it is necessary that the outermost washer 28 be of a lesser diameter than the innermost washer 30. Again, further washers 34 of a substantially lesser diameter than the diameter of the washers 28 or 30 may be interposed between those latter two washers so that a predetermined lateral spacing is maintained between the washers 28 and 30. The legs 18—18 and 20—20 and the washers 28 and 30 are sized such that a spacing of about three-quarters of an inch exits between the washers 30 on each leg pair.

It may also be observed from the front view of FIG. 3 that the washers 25 comprising the roller 24 are mounted between the leg pair 16—16 so that when that roller is in contact with the floor surface and with the mounting plate 12 in a generally horizontal disposition, the inclined roller pairs 28-30 will be raised slightly off the floor. Thus, it is only by inclining the support plate relative to the horizontal that one or the other sets of inclined rollers will engage the surface of the carpeting to be rolled.

OPERATION

When using the tool of the present invention, the carpet installer will generally cut the carpeting to fit into the area whose floor is to be covered. Assuming that the dimensions of the room area are such that it is wider than the width of the carpet, the carpet installer will have to position at least two runs of carpeting on the floor is a side-by-side relationship and, of course, it is desirable that when the job is completed, that the seam line between the two will be essentially invisible.

After the carpeting has been positioned, the carpet installer will pull back the edges of the two carpet runs along the seam line and will place a continuous strip of hot melt adhesive material in its cold state in the area in which the seam will be formed. He subsequently draws a hot iron or other souce of infrared energy along the hot melt strip and then allows the edges of the carpet to fall back onto that strip.

Before the hot melt strip is allowed to cool, he will next use the roller of the present invention to close any lateral gap between the edges defining the seam line and to press the carpet backing into the now-softened hot melt material. More specifically, by holding the tool of the present invention in the plain of his hand, the carpet installer will move the roller 10 along the seam line so that the line is straddled by the inclined washers 30. As he pushes the tool along the seam line, he will rock his hand back and forth as needed to periodically engage the roller pairs 28-30 with the carpeting. Because of the spacing between these rollers and because of the manner in which they are aligned in the individual legs of the leg pairs 18—18 and 20—20 a lateral force is exerted on the carpeting tending to draw the apposed edges thereof into tight intimate contact. Then, by rocking the tool to a more horizontal disposition where only the washers 25 engage the carpeting, only a downward force is applied which tends to force the carpet backing into the softened hot melt material. When any gap is noted in the seam line, the installer need only transfer the pressure to the end-mounted, inclined rollers to create the closing force on the carpeting.

ALTERNATIVE EMBODIMENT

Figure 5:
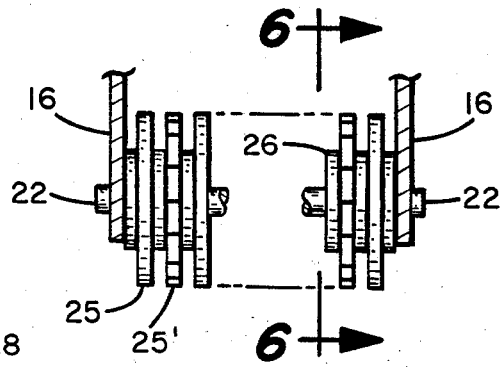
FIG. 5 shows alternative roller construction for use in the tool of FIG. 1.
Figure 2:
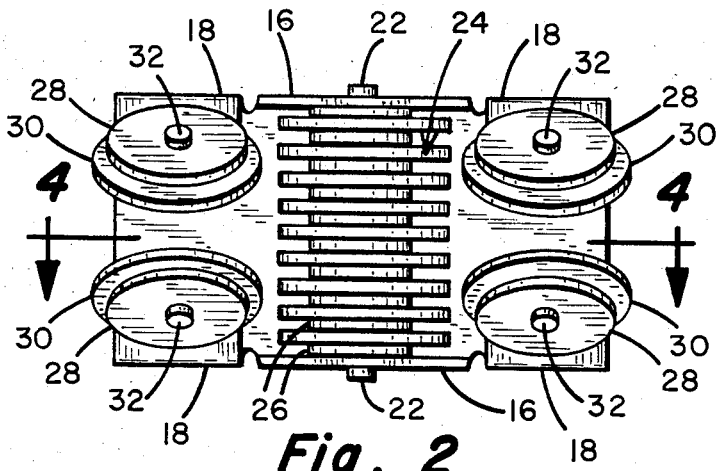
FIG. 2 is a bottom view of the tool of FIG. 1.

Referring to FIG. 5, there is shown an alternative construction of the present invention. Rather than utilizing washers with smooth edge surfaces, when installing certain varieties of carpeting, it has been found expedient to alternate along the axle 22 spiked discs and discs with a smooth periphery. The spiked discs penetrate through the carpet tufts and engage the upper surface of the carpet backing to apply a more direct pressure tending to cause the lower surface of the carpet backing to penetrate deeper into the adhesive material. The tips of the spikes are rounded slightly so as not to leave marks or damage the carpet fibers.

Figure 6:
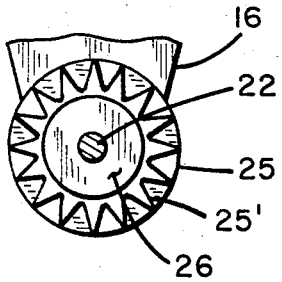
FIG. 6 is a cross-section taken along line 6—6 in FIG. 5.

With still other types of carpeting, notably so-called velvet, it has been found that the tool should incorporate a continuous smooth roller 24 rather than a roller formed from spaced circular discs. This roller configuration is shown in FIG. 6. Using this arrangement, the tendency for the roller to form a noticeable track along the seam line is obviated. This avoids the necessity of later traversing the set seam with a steam wand to raise the nap of the carpeting to get rid of any unsightly tracks.

It is also contemplated that a suitable handle can be affixed to the top surface 14 of the roller mounting plate 12. Then the tool would be used by grasping the projecting handle rather than gripping the tool in the palm of the hand.

There has been shown and described a preferred embodiment of the invention as well as various modifications which may be made to it to accommodate different working conditions. The invention has been described herein in considerable detail in order to comply with the patent statutes and to provide those skilled in the art with information needed to apply the novel principles, and to construct and use such specialized components as are required. However, is to be understood that the invention can be carried out by specifically equipment and devices, and that various other modifications over and above those which have already been explained, both as to equipment details and operating procedures can be effected without departing from the scope of the invention itself.

What is claimed is:

1. A carpet seam rolling tool comprising, in combination:

(a) a roller support blade having a generally planar top surface and at least two pairs of leg members joined thereto, one of said pair of leg members extending out of the plane of said support plate at right angles with the individual legs of said one pair being disposed along opposite side edges of said support plate in a parallel, spaced apart relationship extending out of the plane of said support plate, the individual legs of said other pair being disposed along said opposite side edges of said support plate at an acute angle with respect to one another;

(b) an axle member extending between said first pair of legs;

(c) roller means journaled for rotation on said axle;

(d) separate stub axles affixed to said individual legs of said other pair; and (e) at least two disc members journaled for rotation on each of said separate stub axles at spaced apart locations, said two disc members being of different diameters such that the lower peripheral edge thereof lie on a straight line generally parallel to said support plate.

2. The carpet seam roller as in claim 1 wherein the bottom of said roller means is further from the plane of said support plate than is said straight line.

3. The carpet seam roller as in claim 1 wherein said roller means comprises:

(a) a first and a second plurality of flat washers disposed for rotation on said axle member, one of said second plurality being positioned between adjacent ones of said first plurality, the second plurality being of a lesser diameter than said first plurality.

4. The carpet seam roller as in claim 3 wherein alternate ones of said first plurality of flat washers comprise a multi-pointed star wheel.

5. The carpet seam roller as in claim 1 and further including:

(a) a third pair of leg members journaled to said roller support plate, the individual leg members of said third pair being coplanar with the individual legs of said second pair on each side of said roller support plate;

(b) additional stub axles extending normal to each leg in said third pair; and (c) two further disc members journaled for rotation on each of said additional stub axles, said further disc members being of differing diameter so that the lower peripheral edges thereof lie on a straight line parallel to said support plate.

* * * * *